US007694621B1

(12) United States Patent
Ma

(10) Patent No.: US 7,694,621 B1
(45) Date of Patent: Apr. 13, 2010

(54) LIGHTWEIGHT COMPOSITE ARMOR

(75) Inventor: Zheng-Dong Ma, Ann Arbor, MI (US)

(73) Assignee: MKP Structural Design Associates, Inc., Ann Arbor, MI (US)

( * ) Notice: Subject to any disclaimer, the term of this patent is extended or adjusted under 35 U.S.C. 154(b) by 3 days.

(21) Appl. No.: 12/237,615

(22) Filed: Sep. 25, 2008

Related U.S. Application Data

(63) Continuation-in-part of application No. 11/187,378, filed on Jul. 22, 2005, now Pat. No. 7,490,539.

(51) Int. Cl.
*F41H 5/02* (2006.01)

(52) U.S. Cl. ..... 89/36.02; 89/36.07; 89/36.08

(58) Field of Classification Search ..... 89/36.02, 89/36.07, 36.08, 36.01, 36.09, 36.12
See application file for complete search history.

(56) References Cited

U.S. PATENT DOCUMENTS

| | | | |
|---|---|---|---|
| 821,393 | A | 5/1906 | Wright et al. |
| 3,555,131 | A | 1/1971 | Weismann |
| 3,996,443 | A | 12/1976 | Keller et al. |
| 4,079,560 | A | 3/1978 | Weismann |
| 4,179,979 | A | 12/1979 | Cook et al. |
| 4,226,067 | A | 10/1980 | Artzer |
| 4,268,560 | A | 5/1981 | Maistre et al. |
| 4,328,272 | A | 5/1982 | Maistre et al. |
| 4,395,615 | A | 7/1983 | Tanenbaum et al. |
| 4,448,832 | A | 5/1984 | Kidwell |
| 4,606,961 | A | 8/1986 | Munsen et al. |
| 4,614,013 | A | 9/1986 | Stevenson |
| 4,690,850 | A | 9/1987 | Fezio |
| 4,875,322 | A | 10/1989 | Rozzi et al. |
| 5,108,810 | A | 4/1992 | Williams et al. |
| 5,332,178 | A | 7/1994 | Williams |
| 5,398,470 | A | 3/1995 | Ritter et al. |
| 5,466,506 | A | 11/1995 | Freitas et al. |
| 5,649,403 | A | 7/1997 | Haisch |
| 5,688,571 | A | 11/1997 | Quigley et al. |
| 5,741,574 | A | 4/1998 | Boyce et al. |
| 5,746,765 | A | 5/1998 | Kleshinski et al. |
| 5,763,813 | A | 6/1998 | Cohen et al. |
| 5,804,277 | A | 9/1998 | Ashbee et al. |

(Continued)

*Primary Examiner*—J. Woodrow Eldred
(74) *Attorney, Agent, or Firm*—Gifford, Krass, Sprinkle, Anderson & Citkowski, P.C.

(57) ABSTRACT

Improved composite armor designs uses optimally shaped ceramic pellets, a specific stacking geometry and a web system for patterning the pellets, improving manufacturability, and providing additional structural reinforcement. Lightweight, composite ballistic armor according to the invention may comprise an array of ceramic pellets, each pellet having a front surface, a back surface and a longitudinal centerline, and wherein the front surface of each pellet is intentionally convex. The front surface of each pellet may be hemispherical, in which case the cross-section of the pellet taken perpendicular to the centerline may be oval-shaped. Alternatively, the front surface of each pellet may be elliptical, in which case the cross-section of the pellet taken perpendicular to the centerline may be circular. In the preferred embodiment, the back surface of each pellet is formed at the same angle relative to its centerline, with the pellets being arranged with the flat surfaces lying in a plane. The pellets may be arranged in a square matrix, or may be arranged in a hexagonally close-packed matrix. The array of pellets may be embedded in a hardened matrix material, and/or tied together with netting material.

16 Claims, 11 Drawing Sheets

U.S. PATENT DOCUMENTS

| | | | | |
|---|---|---|---|---|
| 5,806,798 | A | 9/1998 | Gillandt et al. | |
| 5,869,165 | A | 2/1999 | Rorabaugh et al. | |
| 5,904,025 | A | 5/1999 | Bass et al. | |
| 5,962,150 | A | 10/1999 | Priluck | |
| 5,981,023 | A | 11/1999 | Tozuka et al. | |
| 6,112,635 | A | 9/2000 | Cohen et al. | |
| 6,203,908 | B1 | 3/2001 | Cohen et al. | |
| 6,207,256 | B1 | 3/2001 | Tashiro et al. | |
| 6,237,297 | B1 | 5/2001 | Paroly | |
| 6,289,781 | B1 * | 9/2001 | Cohen | 89/36.02 |
| 6,430,344 | B1 * | 8/2002 | Dixon et al. | 385/109 |
| 6,644,535 | B2 | 11/2003 | Wallach et al. | |
| 6,645,333 | B2 | 11/2003 | Johnson et al. | |
| 6,681,981 | B2 | 1/2004 | Paroly | |
| 6,708,922 | B1 | 3/2004 | Hamilton et al. | |
| 6,807,891 | B2 * | 10/2004 | Fisher | 89/36.02 |
| 6,892,623 | B2 | 5/2005 | Benyami et al. | |
| 7,117,780 | B2 | 10/2006 | Cohen et al. | |
| 2003/0017053 | A1 | 1/2003 | Baldwin et al. | |

* cited by examiner

LIGHTWEIGHT COMPOSITE ARMOR

REFERENCE TO RELATED APPLICATION

This application is a continuation-in-part of U.S. patent application Ser. No. 11/187,378, filed Jul. 22, 2005, the entire content of which is incorporated herein by reference.

GOVERNMENT SUPPORT

This invention was made with government support under Contract No. W56 HZV-05-C-0098, entered into with the United States Army Tank-Automotive Research, Development and Engineering Center (TARDEC). The Government may have certain rights in the invention.

FIELD OF THE INVENTION

This invention relates generally to ballistic armor and, in particular, to a lightweight composite ballistic armor for military and tactical vehicles and armored civilian vehicles as well as buildings protecting people, machinery, supplies and fuel.

BACKGROUND OF THE INVENTION

The terrorist attacks of Sep. 11, 2001 in New York City and Washington, D.C., and the current war in Iraq, have heightened the need for ballistic armor. Military vehicles, in particular, are vulnerable to higher-potency weapons such as rocket-launched grenades and other projectiles. Military personnel want lightweight, fast and maneuverable vehicles, but they also want vehicle occupants to be fully protected. Ballistic steel armor plates, while relatively inexpensive, add thousands of pounds to a vehicle, many of which were not designed to carry such loads. This has resulted in numerous engine and transmission failures as well as problems with vehicle suspensions and brakes. The additional weight reduces fuel efficiency and makes it impossible to carry additional personnel in the vehicle in case of emergency. For these reasons, designers are beginning to adopt more lightweight composite armor across the board for military and tactical vehicles.

Various lightweight armor designs are now becoming commercially available. Cellular Materials International, Inc. of Charlottesville, Va. offers a product called Microtrussm, a periodic cellular material designed to absorb a larger amount of energy than solid material of equal mass. When a blast hits the face of the sandwich panel, the face plate will stretch and wrinkle followed by the propagation of the impulse force into the core. The core will then buckle and collapse, absorbing the maximum kinetic energy of the blast. The back face plate takes the remaining blast pressure towards the end of the blast event where the intensity of the impulse force is considerably reduced. Thus, the periodic structure maximizes the absorption of the impulse energy created by the blast and distributes or diffuses the intensity of the force, leading to protection of the assets behind the sandwich structures.

Designs using ceramic pellets are also evolving. U.S. Pat. No. 6,203,908 is directed to a composite armor for absorbing and dissipating kinetic energy from high velocity projectiles. The armor comprises a panel having a layer of a plurality of high density ceramic bodies, the bodies having a specific gravity of at least 2 and being made of a material selected from the group consisting of ceramic material which does not contain aluminum oxide and ceramic material having an aluminum oxide content of not more than 80%. Each of the bodies is substantially cylindrical in shape, with at least one convexly curved end face, and each of the bodies having a major axis substantially perpendicular to the axis of its respective curved end face, wherein the ratio D/R between the diameter D of each of the cylindrical bodies and the radius R of curvature of the respectively convexly curved end face of each of the bodies is at least 0.64:1, and wherein the bodies are arranged in a plurality of adjacent rows and columns, the major axis of the bodies being in substantially parallel orientation with each other and substantially perpendicular to an adjacent surface of the panel.

Ballistic armor utilizing ceramic components is also commercially available. ARES Protection, Le Bourg 38270, Primarette, France offers a product called LIBA, which stands for light improved ballistic armor. The armor is a system consisting of one or more layer(s) of spherical ceramic pellets glued with (or without) a backing material and embedded in a polyurethane matrix LIBA is for body and vehicle protection applications, especially to stop AP ammunitions. LIBA is developed for protection against WC bullets and hollow charges.

Despite these advances, the need remains for an improved, more optimized lightweight composite armor for military and tactical vehicles and other applications.

SUMMARY OF THE INVENTION

The present invention improves upon existing composite armor designs through the use of optimally shaped ceramic pellets and a three-dimensional fiber network system for patterning the pellets, improving manufacturability, and providing additional structural reinforcement. The result is lightweight, composite hybrid structures for ballistic protection particularly suited to tactical ground vehicles. Due to the flexibility of the system, however, the armor can also be used, with minimum modifications, to protect commercial vehicles. The armor system can be further extended for other usages, for example, in a chair-based armor system to protect driver and passengers, or attached to office walls, ceilings, floors and exterior structures to protect officers, or even as personal armor.

To further deflect an incoming projectile and defeat penetration, pellets with convex crowns may be used according to embodiments of the invention. Such lightweight, composite ballistic armor, comprises an array of ceramic pellets, each pellet having a front surface, a back surface and a longitudinal centerline, and wherein the front surface of each pellet is intentionally convex. The front surface of each pellet may be hemispherical, in which case the cross-section of the pellet taken perpendicular to the centerline may be oval-shaped. Alternatively, the front surface of each pellet may be elliptical, in which case the cross-section of the pellet taken perpendicular to the centerline may be circular.

In the preferred embodiment, the back surface of each pellet is formed at the same angle relative to its centerline, with the pellets being arranged with the flat surfaces lying in a plane. The pellets may be arranged in a square matrix, or may be arranged in a hexagonally close-packed matrix. To improve stability in normal use (under vibration loads, impact energy absorption and manufacturability), the array of pellets may be embedded in a hardened polymer or metal matrix material, and/or tied together with a fiber network.

Arrays of pellets may be embedded in a hardened polymer or metal matrix material to form a single front plate. One or more of these front plates may be attached to a single back plate. The system may further include a flexible net-like, support structure with a plurality of armor tiles attached to the support structure, each tile including one or more front plates disposed on one side of the support structure, a back plate disposed on the other side of the support structure, and one or more fasteners for joining each front plate to a corresponding back plate through the support structure. An alternative embodiment has the support structure behind the back plate. Each back plate may itself be a composite structure including opposing panels filled with a resin impregnated matrix. The back and front plates may be co-extensive, and the web-based support structure may be bendable along lines between the tiles, resulting in a hinged sheet that can be draped over a vehicle or other thing to be protected.

DETAILED DESCRIPTION OF THE INVENTION

Figure 1A:
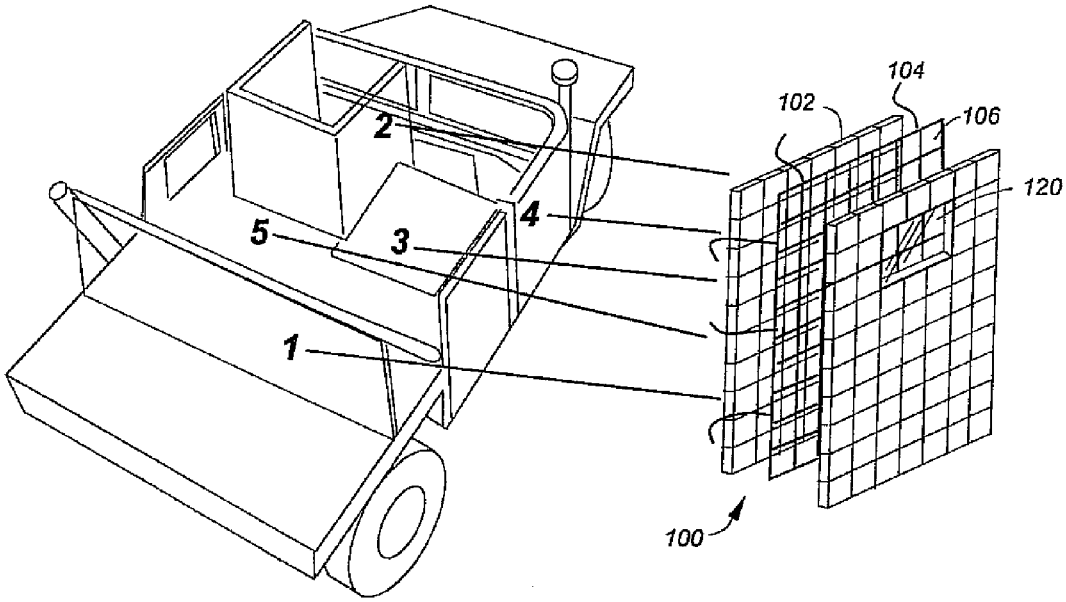
FIG. 1A shows composite armor characteristics and vehicular installation positions.
Figure 1B:
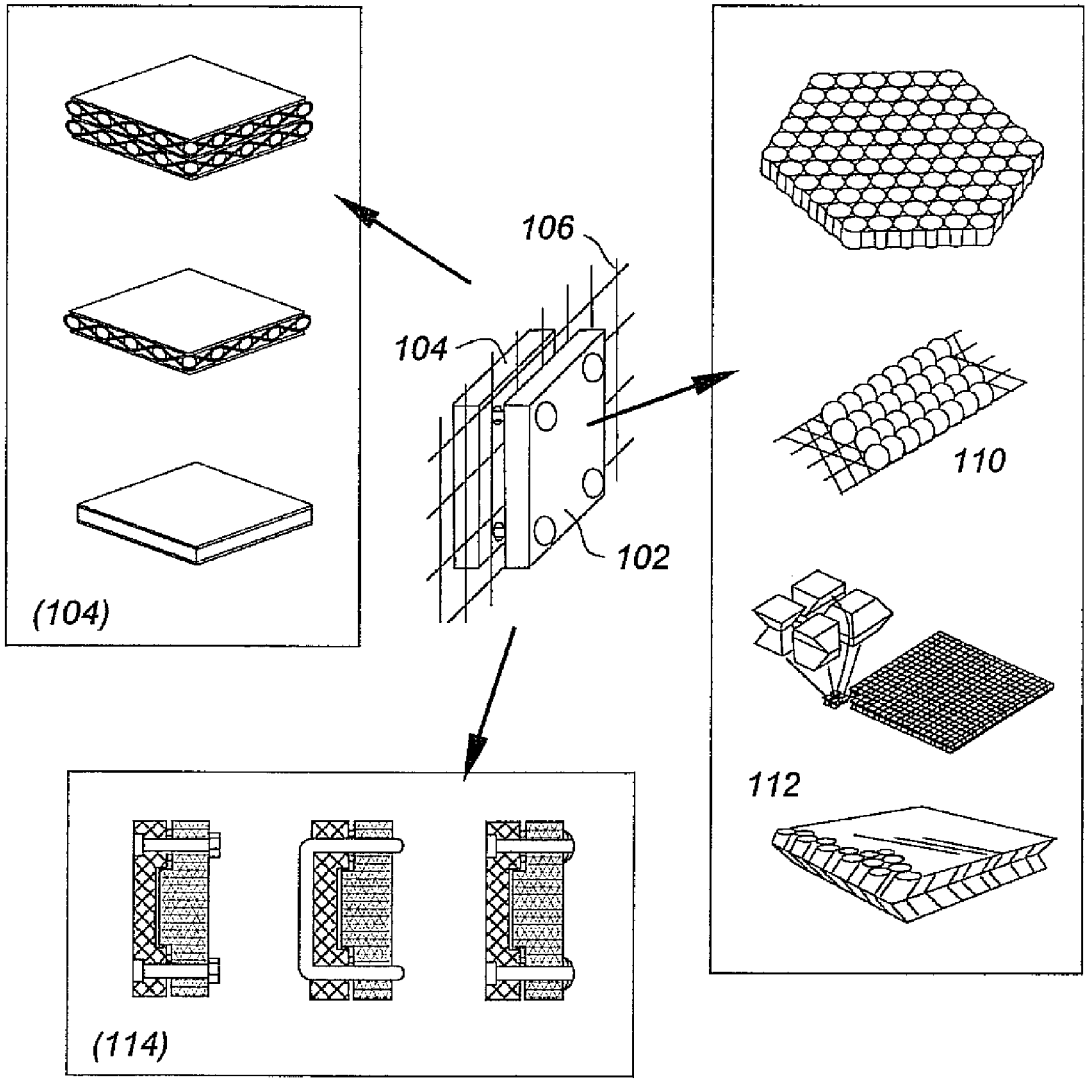
FIG. 1B shows different construction alternatives according to the invention.

Basic armor configuration (100) according to the invention is illustrated in FIG. 1A. FIG. 1B shows different construction alternatives. Each include three major modules: 1) a functionally oriented material (FOM) tile (102) as the front plate, 2) a Bio-mimetic Tendon-Reinforced (BTR) back plate 104, and 3) supporting structure 106 using a fabric web. Various alternative embodiments are available in each case. As described in further detail below, the front plate may use pellets arranged in a regular structure (110), of the pellets may use a designed shape (112). In the preferred embodiment, the back plate may be constructed using any of the forms disclosed in co-pending U.S. patent application Ser. No. 11/023,923, the entire content of which is incorporated herein by reference. Other embodiments include the use of a solid plate of aluminum or other suitable metal or polymer material. The front and back plates may be joined with a clip mechanism (114), or other disclosed alternatives may be used. In the preferred embodiment, the front and back plates are co-extensive, and arranged in an array shown at 100 facilitating easier replacement. If the resulting "blanket" is draped over the front or side of a vehicle, an optional bullet-resistant window (120) may be provided.

The front plate is preferably composed of ceramic pellets arranged in a periodic pattern designed for improving the ballistic resistance, especially in the presence of multiple hits. The pellets may be contained in a single-layered or three-dimensional metal or fiber network filled by thermoset or thermoplastic polymer material. The polymer may be further improved by use of nano clay to improve resistance to crack propagation. The ceramic pellet will have an optimally designed shape, which enhances the transferring of impact load onto surrounding pellets. This feature results in desired compress stress among the pellets, which reduces the crack propagation and improves the out-of-plane impact resistance performance.

The ceramic pellets in the tile are seated in a fabric network, and are molded with the selected thermoset or thermoplastic polymer material. The polymer material functions as impact absorber and position keeper of the pellets and may have nano-clay particles molded in to further improve resistance to crack propagation. The fabric network in the ceramic layer has two major functions: one is to keep the pellets in a desired arrangement and the other is to reinforce the ceramic layer during the ballistic impact.

The back plate features ultra-light weight and outstanding out-of-plane stiffness/strength. It is designed to have improved bending stiffness and strength for optimizing the armor performance. The back plate, combined with one or more face plates, is referred to herein as an Armor Tile.

The fabric net is designed to hold the armor tiles (ceramic layer and back plate) in place and form an integrated armor kit that can fill into various vehicle contours. The optimally designed supporting structure also provides the advanced features of low cost and ease of installation, replacement, and repair.

The Front Plate

Each layer of ceramic pellets provides improved ballistic performance under conditions of single and multiple hits in several ways: Crack propagation is limited at the boundary of each individual pellet; An individual crack must propagate through the fabric web and thermoset or thermoplastic polymer matrix; The inclined angle of the stacked pellets will tend to rotate the incoming projectile and reduce the damage to the underlying target; The domed geometry of the individual pellets will further deflect and redirect the incoming projectiles away from the target. In one embodiment, commercially available ceramic pellets are used; however, in the preferred embodiments pellets of purpose-designed shapes are used.

There are two kinds of ceramic pellets with simple shapes that are commercially available, including spherical and cylindrical versions. These pellets are used in manufacturing industry as grinding media in size-reduction mills of various types. We have identified pellets made from Alumina ($Al_2O_3$) with the purity of 93%, 96.5% and 99.5%. Other candidate materials include Alumina with higher purity, Zirconia-Toughened Alumina, Yttria (Y2O3) Partially Stabilized Zirconia.

Figure 2:
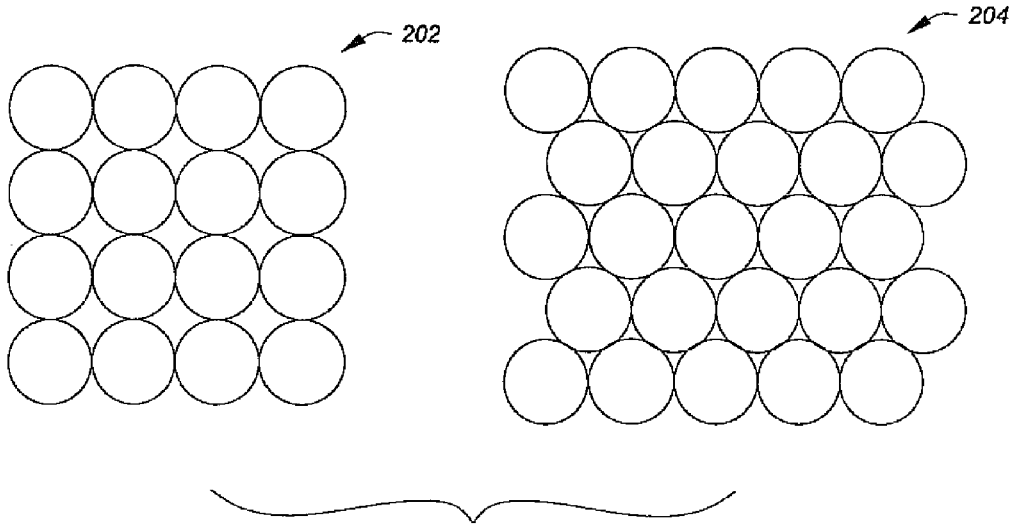
FIG. 2 shows two alternative patterns according to the invention.
Figure 3A:
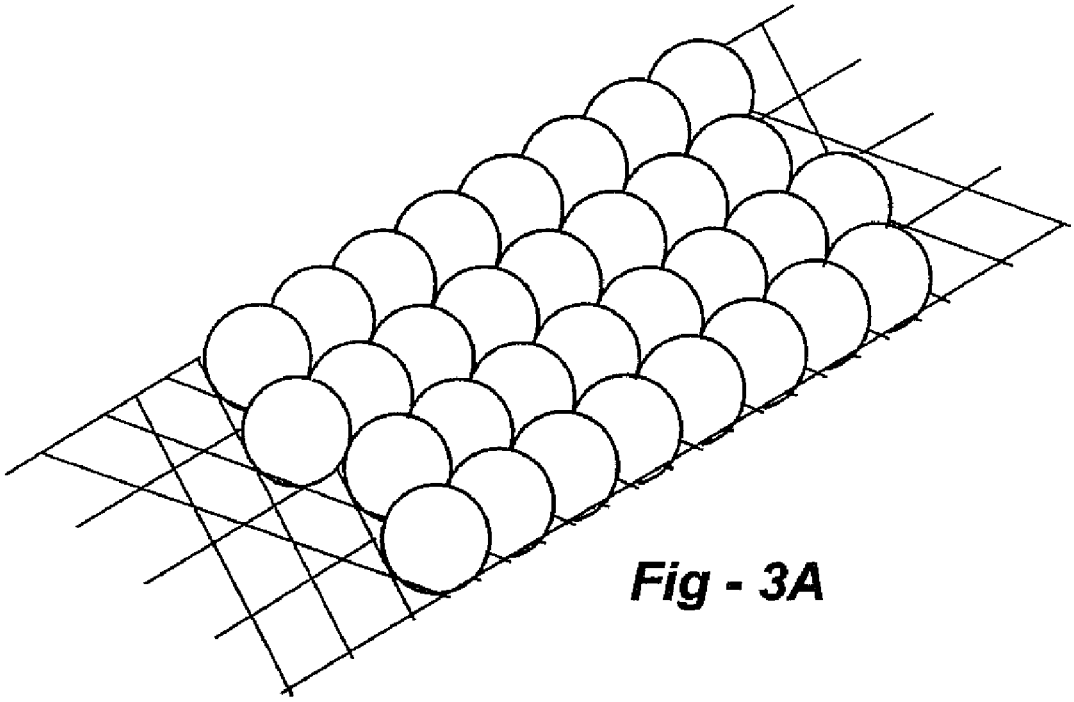
FIG. 3A shows pellets and fiber network structures inside the ceramic based face plate.

There are two patterns for the ceramic pellet layering, namely, the square and honeycomb arrangements 202, 204 as shown in FIG. 2. In the preferred embodiment the ceramic pellets are packed in a hexagonal close-paced arraignment (also known as a honeycomb). A lower-density, square packing is possible and may have advantages if the thermoset or thermoplastic matrix and fabric layers require additional spacing for optimal performance, or lower weight. It is also desirable to improve the in-plane and out-plane bending stiffness and strength of the simple ceramic layer. To achieve this goal, a single or multi-layer fabric net structure is used as the pellet holder during fabrication. This fabric net provides structural reinforcement, providing resistance to tensile loads and flexural stiffness. The compound structure of the ceramic pellets and the fabric net are further molded in a thermoset or thermoplastic matrix. One single-layered net design with honeycomb pattern is shown in FIGS. 3A and 3B.

Figure 3B:
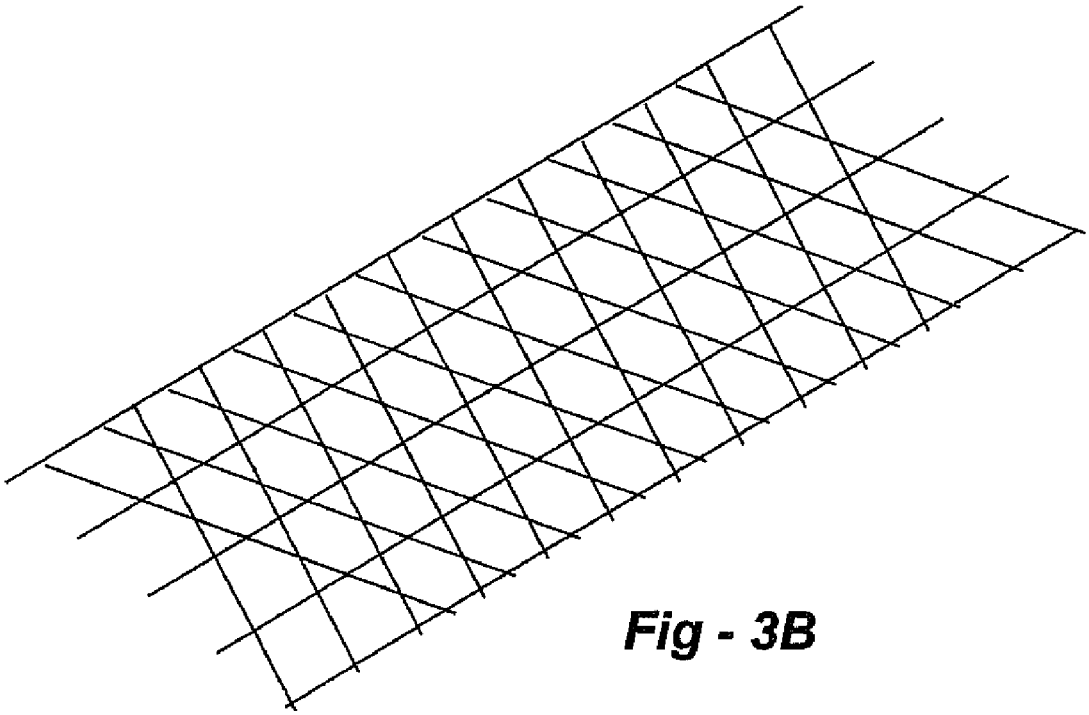
FIG. 3B shows the fiber net structure aligned with the pellets to provide reinforcement.

From FIG. 3B, it is seen that the fabric net structures will serve to align the ceramic pellets and hold them in place during the manufacturing process. After the thermoset or thermoplastic matrix is cured with the ceramic pellets, the net structures will provide reinforcement in resisting tensile stress, which is one weakness of a layer comprised of only ceramic pellets and the matrix. The net structure can also be three dimensional, which could provide additional reinforcement to the whole composite. The material selected for fabricating the web will be a high-strength fiber such as para-aramid synthetic fiber.

The matrix material holds the ceramic pellets together and absorbs the vibration and impact energy under normal working conditions, so that the armor will not change configuration or be damaged in normal loading conditions (such a driving a vehicle). Under ballistic impact, it is expect the matrix material will not be strong enough to defeat of the projectiles. However, it is expected that the matrix material have the capabilities to absorb significant amounts of the impact energy and prevent collateral damage to surrounding pellets. A thermoset or thermoplastic material is applicable to this purpose, depending upon cost, manufacturability, and reparability.

The Back Plate

Figure 4:
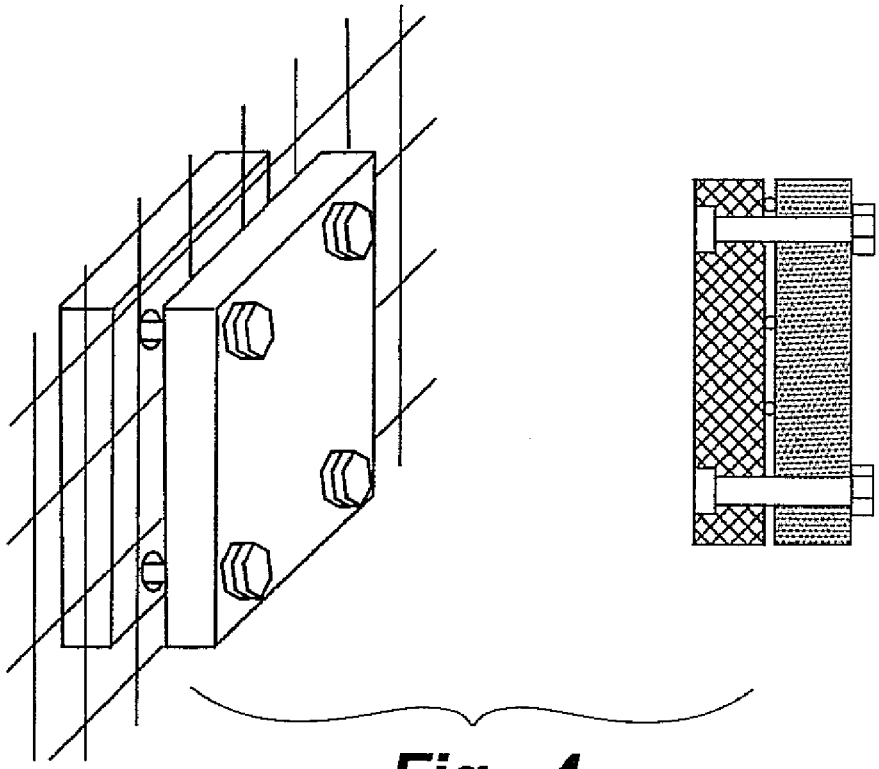
FIG. 4 shows a back plate using bolts.
Figure 5:
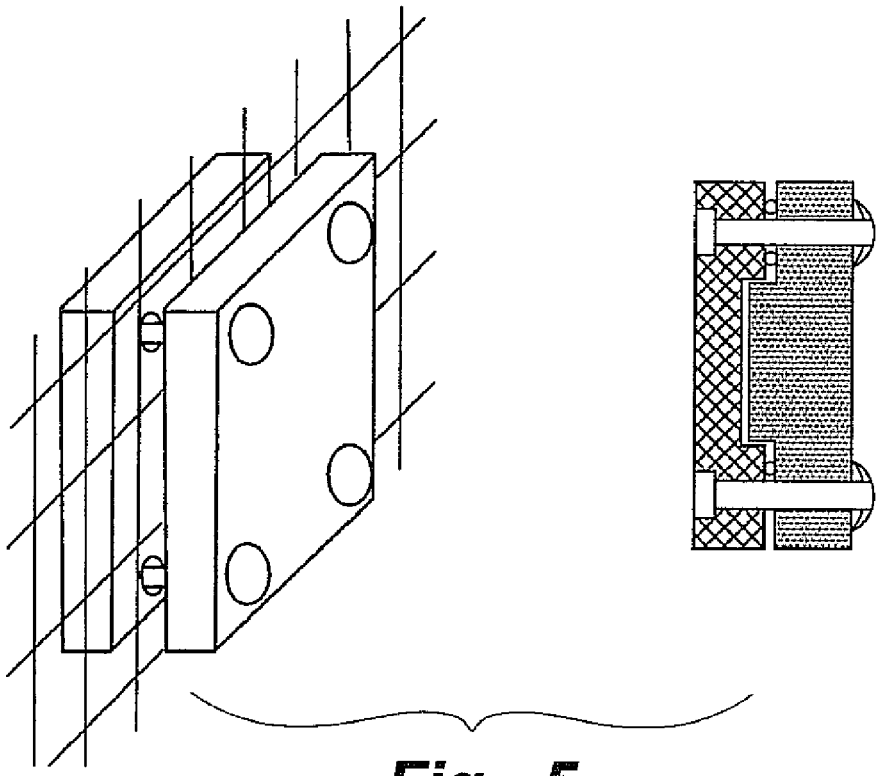
FIG. 5 shows groove and clip-on mechanisms.
Figure 6:
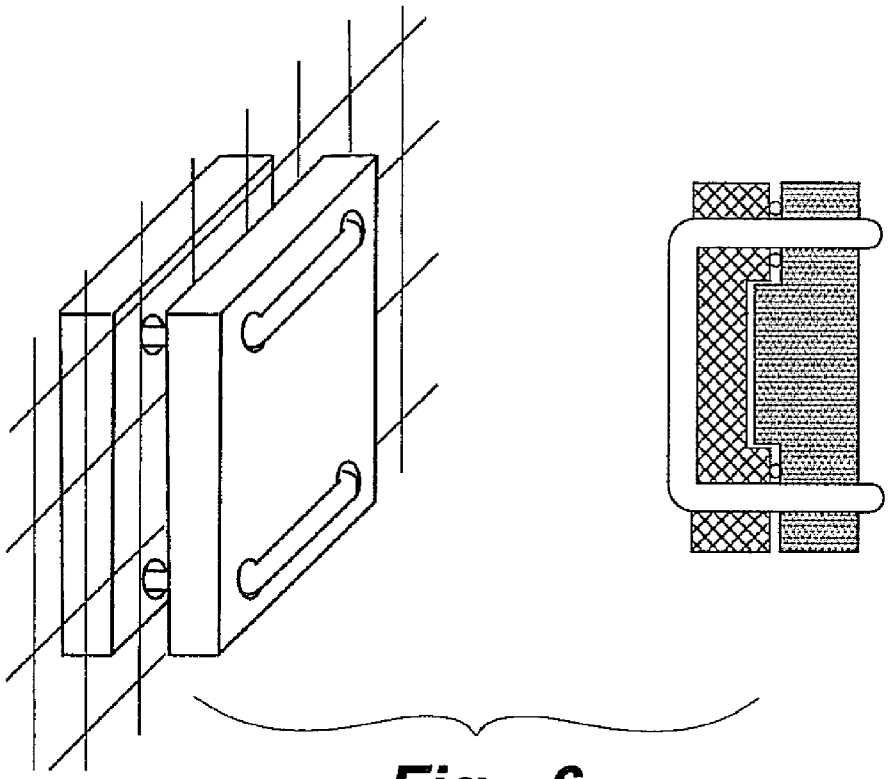
FIG. 6 shows a metallic wire fastener.

In the preferred embodiment, the back plate employs the patent-pending BTR material concept, which features ultra-light weight and outstanding out-of-plane stiffness/strength. The ceramic face plates may be connected to the back plates using bolts (FIG. 4), clip designs (FIG. 5), or metal wire/cable. (FIG. 6) The supporting structure (net structure) is clamped between the ceramic face plate and back plate, as shown in FIGS. 4 to 6.

Effectiveness

The ballistic impact on a homogeneous ceramic layer leads to damage through mechanisms that are different in different stages of the penetration. At initial impact, the high hardness of ceramic materials helps to flatten the projectile tip. The damage to the ceramic is localized at this stage to a relatively confined area under the projectile as only compressive forces are in effect. In the second phase, propagation of the reflective wave (tensile wave) causes material damage at the back of the ceramic layer because ceramics are weak in tension. At this point the damage zone is like shaped like a mushroom. Then cracks initiate from the root of the mushroom because of the bending of the ceramic layer. At the same time, the cap of mushroom becomes larger, expanding inside the ceramics with a certain angle (~60 degrees) relative to the axis of the mushroom. Finally, the mushroom cap cracks, causing fragmentation of the ceramic layer and the debris is kept in place to stop the projectile with the help of back plate. This process continues until the back plate fails. Homogenous, traditional, ceramic materials are hard and brittle. The high hardness contributes to flatten the nose part of the incoming projectiles, which increases the forces to stop the projectiles. The brittle properties of ceramics are not good for sustained defeating of projectiles, however, the damage zone forms due to this helps to distribute the impact force over a larger area. Another effect of brittleness of ceramic material is the long cracks usually expand from the point of impact due to bending. It is believed that these long cracks, creating small pieces of ceramic material, reduce the penetration resistance of the armor because there is limited in-plane constraint to keep the ceramic in place. Loss of mass through ejection of material permits in further penetration of the projectile.

As mentioned in the previous section, there are many mechanisms which help to improve the ballistic performance of armor. There are also many other mechanisms which compromise the overall performances. The goal is to promote the "good" mechanisms, and suppress "bad" ones. We identified good mechanisms as:

A) Hardness of ceramic to flatten the tip of projectile at the initial stage of impact;

B) Transference of impact force to surrounding and supporting materials;

C) Constraints of material to prevent material "flee" from the impact zone;

D) Other aspects to defeat projectile by involving more materials in the impact zone; and bad mechanisms as:

E) Long cracks propagation;

F) Large damage zone.

Based upon these observations, the ceramic layer will preferably include ceramic pellets to form a mosaic as opposed to an entire piece of ceramic material. With this approach, the following advantages should be realized:

A) The hard pellets will be able to flatten the tip of the projectile;

B) The special geometry of the pellets will be able to transfer the impact force (in form of compressive stress) to surrounding pellets as far as possible;

C) Special shape of the surrounding pellets helps to hold the material in the impact zone;

D) If the projectiles can be designed to change the penetration angle of the bullet, the armor will be much more effective. Therefore, the bigger the angle change is, the better the armor performances will be;

E) Boundaries between the pellets help to stop the propagation of cracks;

F) Damage will be restricted in a limited range due to the fact that long cracks can be stopped from its initiating stage.

G) Damage will be further restricted to a limited range due to the fact that long cracks in the polymer matrix can be stopped from further propagation due to the presence of nano-clay particles in the matrix.

Figure 7:
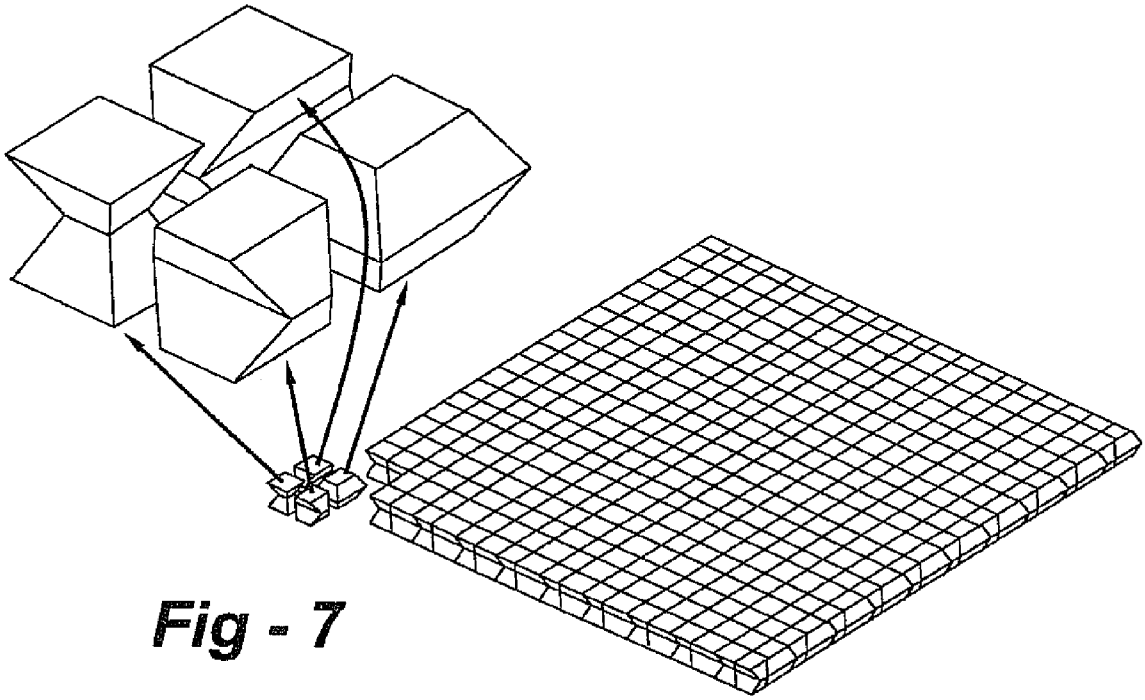
FIG. 7 shows a concept for ceramic layer with improved performances.

The ceramic layer design can be seen as an effort to promote the above features by optimally configuring the basic components in the ceramic layer. FIG. 7 illustrates an example concept of the ceramic mosaic. In this concept, the ceramic pellets have a particular geometry, which helps to transfer impact load to surrounding pellets. The transfer of force to surrounding tiles will be in form of compressive stress, which is favorable for ceramic materials. Because the boundary of tiles restrains the propagation of cracks, the design will have better multi-hit performance. The pellets are molded in thermoset or thermoplastic polymer materials, which functions as impact absorber and keep the tiles in place. The design will have better dynamic performances because of the thermoset or thermoplastic material used.

Using this approach, the projectile penetration angle can be deflected due to the asymmetric design of the ceramic pellets. The angle deflection, although it is small, greatly improve the chance of defeating the projectile. Because a face plate composed of ceramic blocks will lack tension and bending strength, an optimized cable network will be included in the ceramic layer for reinforcement during normal work conditions and under ballistic impact. Thematrix will be selected to absorb the shock wave and prevent ceramic damage in normal work conditions and under ballistic impact. Other important concerns include manufacturability and cost.

Figure 8:
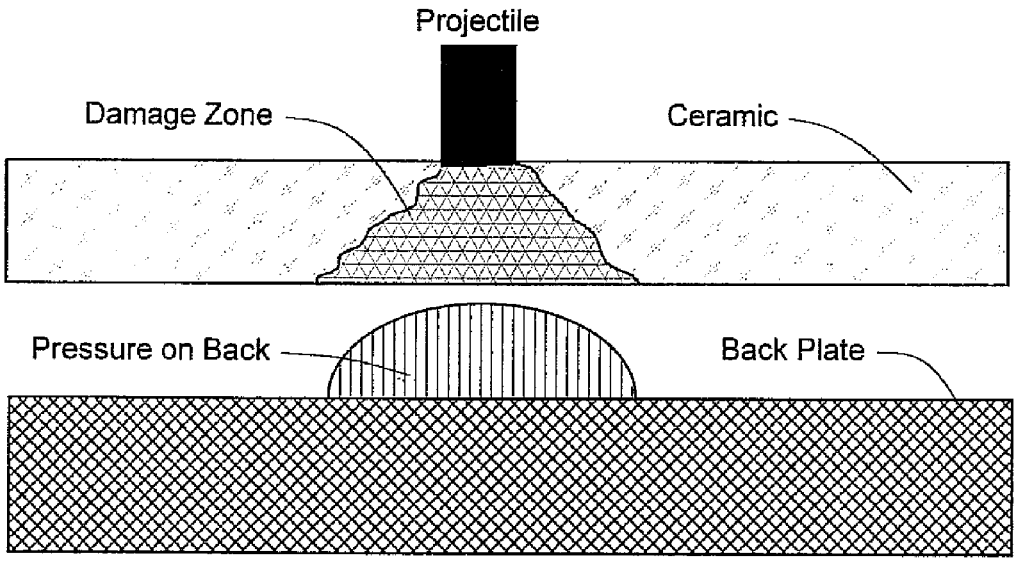
FIG. 8 shows impact force acting on the back plate.

As discussed above, the back plate should have large bending stiffness to prevent excessive bending of ceramic layer, the bending is an undesired deformation for the ceramic layer. At the same time, back plate should have large bending strength to hold the damage ceramic material in place to continue to stop the projectile. At the same time, the back plate should be able to collect debris from projectiles and ceramic layer and to stop them from penetration. Thus, the force acting on the back plate will be a distributed force, depicted in FIG. 8.

The Support Structure

The supporting structure is the structure between the armor kits and vehicle structures. It provides the benefit of easy installation, and also can be designed to improve the ballistic function of armor kits. Traditionally, armor kits are bolted on the structures for which they provide protection. If this traditional method is applied, there is an additional task to fit the geometry of the armor kit to the back structures. Therefore, we proposed an alternative method to mount the armor kits with an additional supporting structure. This supporting structure will provide additional benefits, such as easy to install, replace and repair.

At least two alternative supporting structures are possible. The first is a net structure that the armor kits are attached to, as shown in FIGS. 4-6. The benefit of this design will be lightweight and easy to install on different kinds of surfaces. The second one is made of fabric cloths, such as a para-aramid fiber, which has arrays of pockets that the armor tiles can be inserted in. This concept is similar to the body armor except a large number of armor inserts will be used.

Figure 9A:
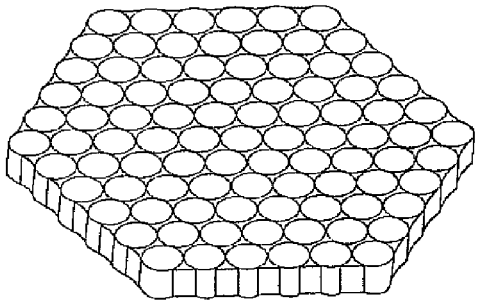
FIG. 9A illustrates ceramic cylinders.
Figure 9B:
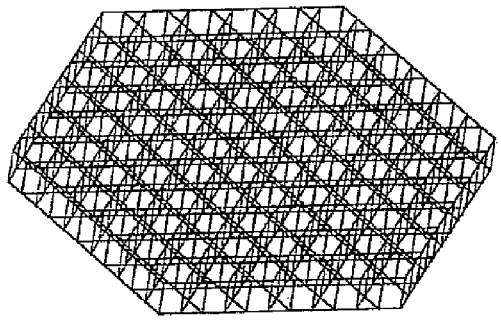
FIG. 9B illustrates a cable network.
Figure 9C:
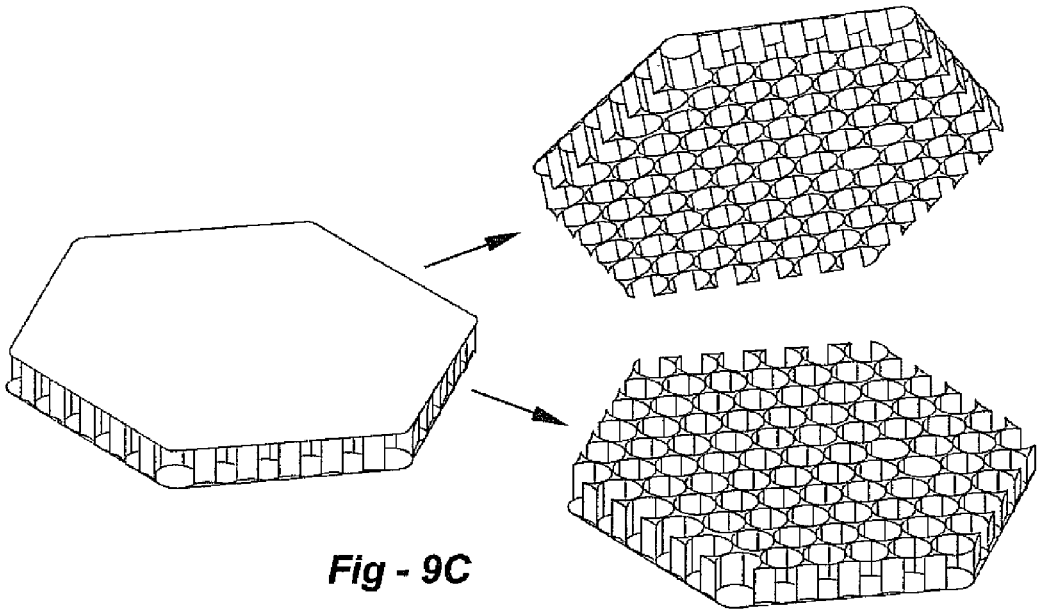
FIG. 9C illustrates a matrix.

In terms of materials, different kinds of materials are combined to defeat the projectile effectively. Ceramic pellets or cylinders function to damage and to rotate the projectiles. Optimized cable network provides reinforcement when tension and bending loads exist on the armor plate. Matrix material functions to absorb shock waves and to keep the structural integrity. FIGS. 9A-9C illustrates an armor design with ceramic cylinders, cable network, and matrix.

We have identified polycarbonate as a suitable matrix material. Aluminum is another suitable material. Para-aramid fiber is preferable as the cable material in the face plate and back plate because para-aramid fiber is widely used in body armor and has superior ballistic performances.

Figure 10:
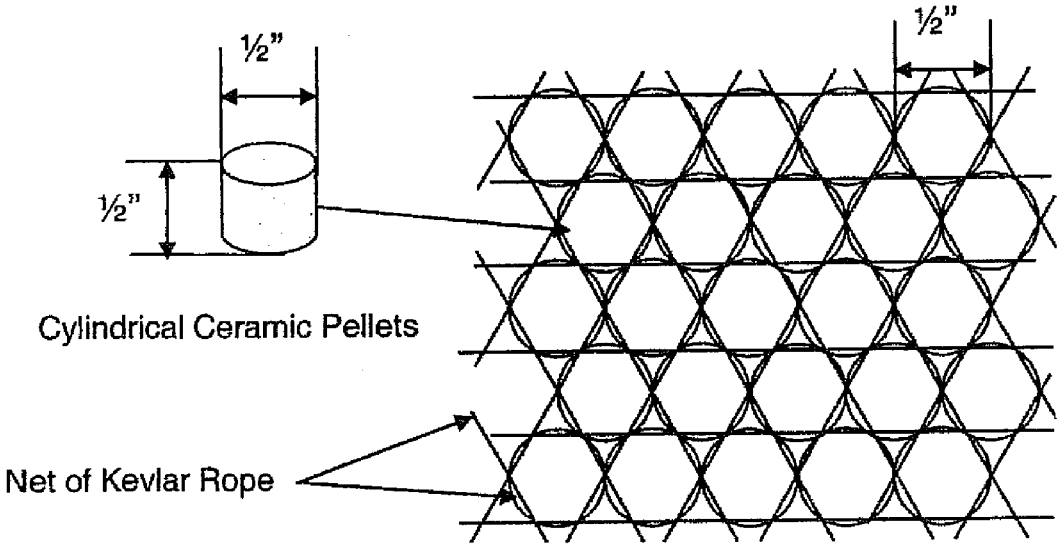
FIG. 10 illustrates a design with ceramic pellets and a cable network.
Figure 11:
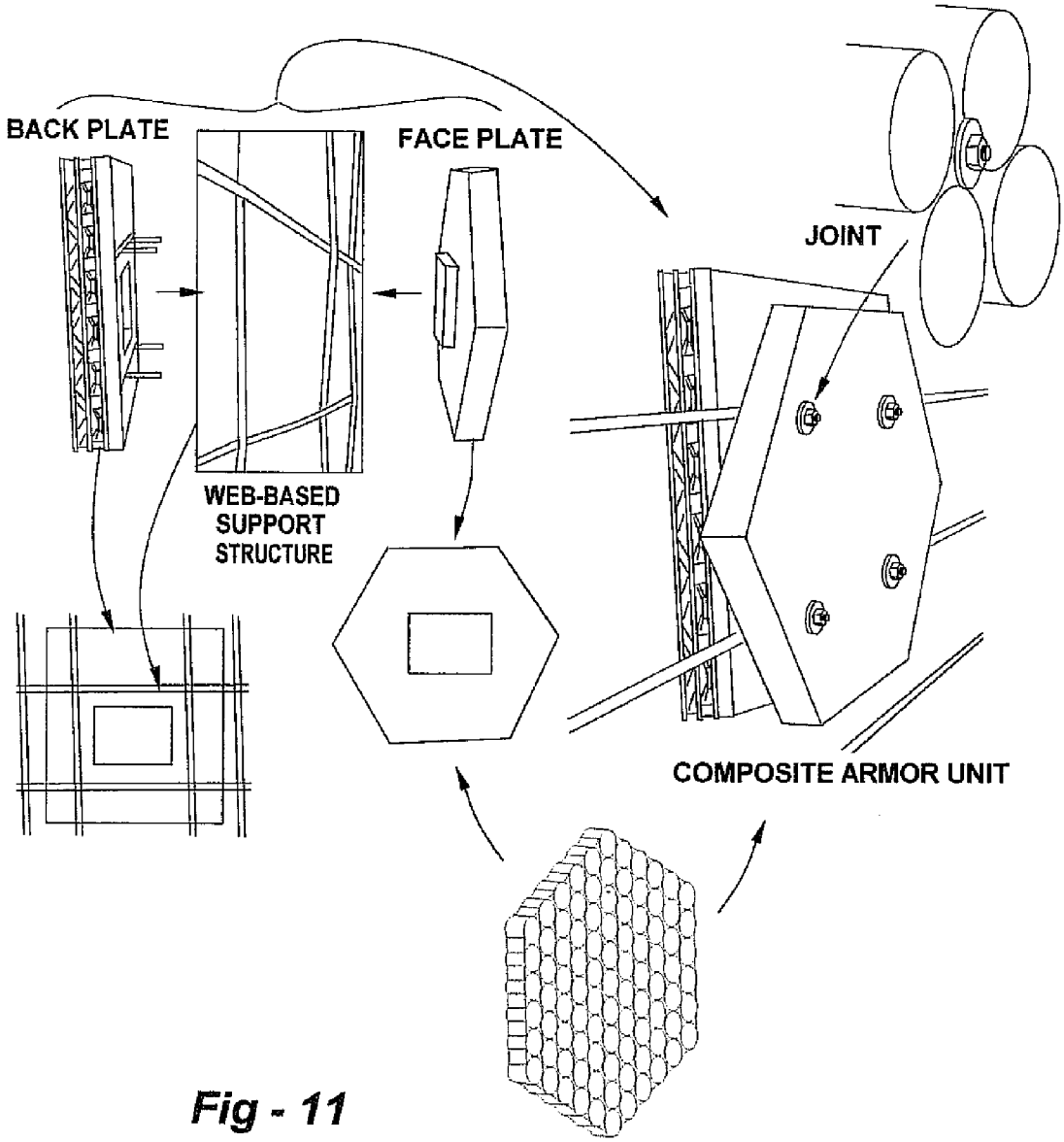
FIG. 11 shows a composite armor unit including a web-based supporting structure and pellet array.

FIG. 10 shows a ceramic pellet layout and a holding net designed for the face plate. This prototype face plate has a total volume of 272.8 cm3, total weight of 832 g, and density of 3.05 g/cm3, which is 60% lighter than steel (7.8 g/cm3), 19% lighter than homogeneous ceramic (3.8 g/cm3), and only 10% heavier than aluminum (2.7 g/cm3). FIG. 11 shows a composite armor unit including a web-based supporting structure and pellet array.

Figure 12:
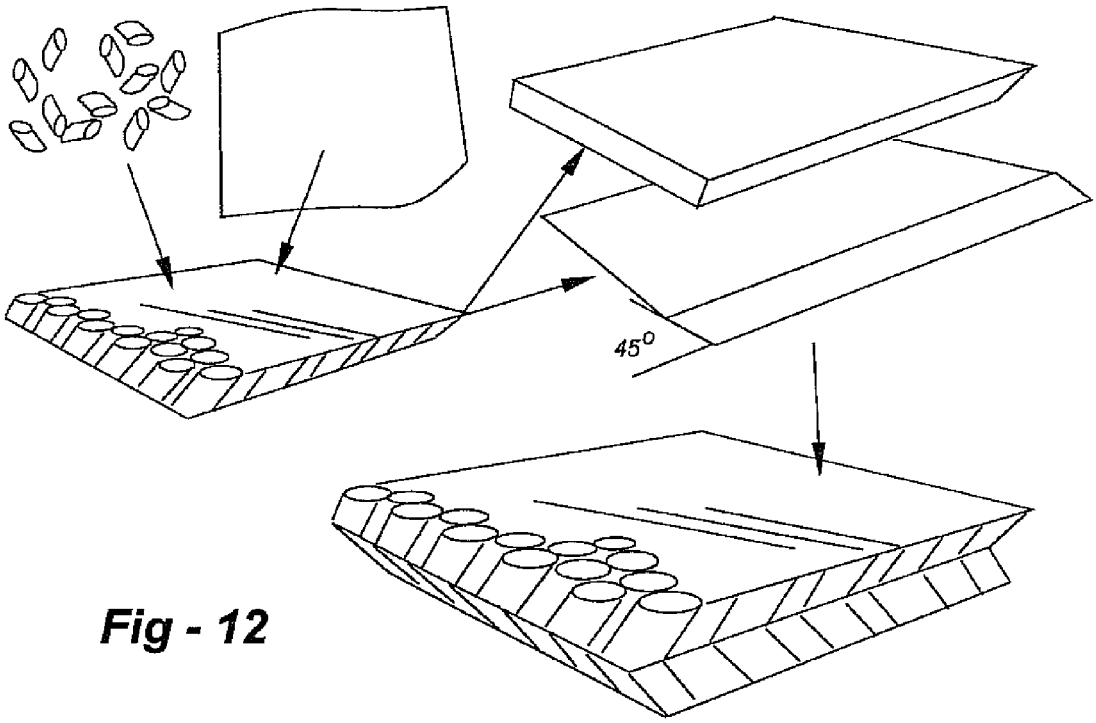
FIG. 12 illustrates the use of angle-cut cylindrical ceramic pellets.
Figure 13A:
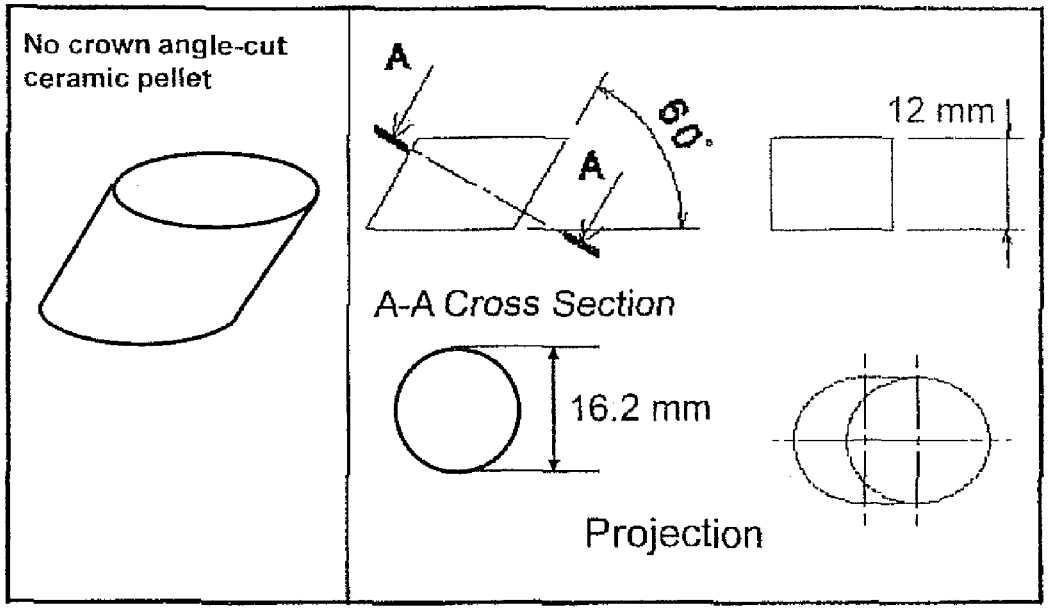
FIG. 13A shows a pellet according to the invention cut at an angle of 60 degrees.

FIG. 12 illustrates the use of angle-cut cylindrical ceramic pellets. From experimental results, it was found that two structural layers with ¼" hemp stuffers, 1/16" para-aramid fiber ropes, 12 layers of woven para-aramid fiber, and Epoxy matrix has the best performance in terms of bending stiffness. Although an angle of 45 degrees is indicated, it will be apparent to those of skill that other angles are possible. For example, FIG. 13A shows a pellet according to the invention having an angle of 60 degrees. In the embodiment shown, the cross section is 16.2 mm and the height is 12 mm.

Figure 13B:
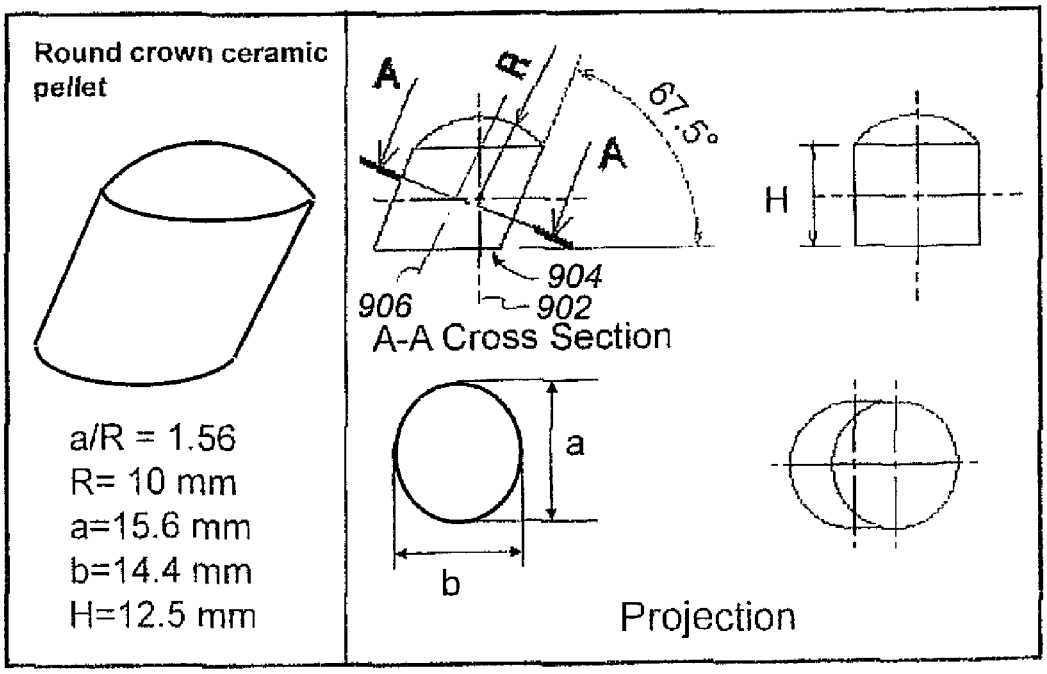
FIG. 13B shows a pellet according to the invention cut at and angle of 67.5 degrees and having a hemispherical crown.
Figure 13C:
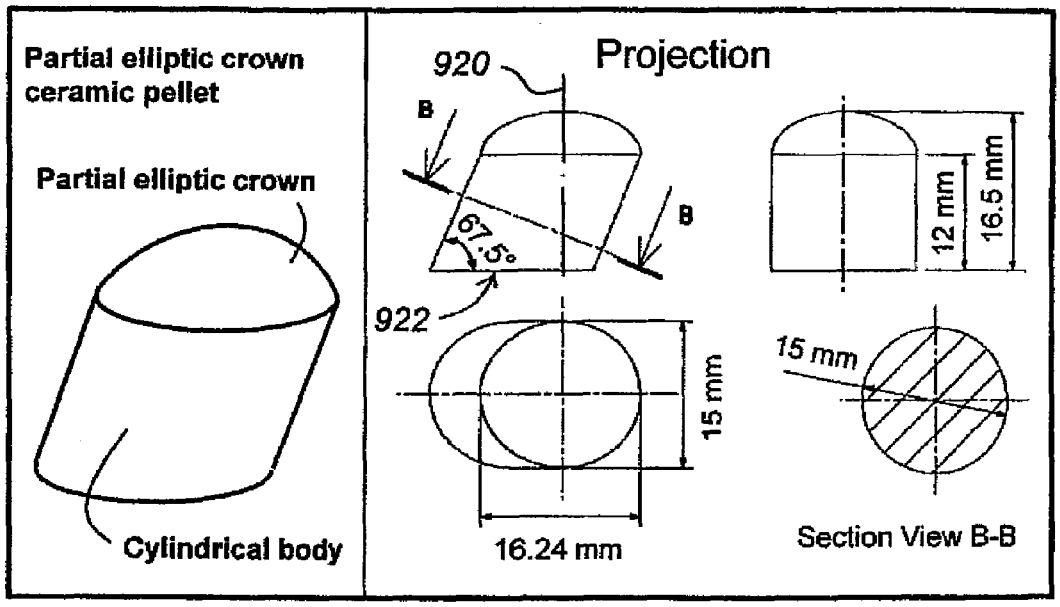
FIG. 13C shows a pellet according to the invention cut at and angle of 67.5 degrees and having a partial elliptical crown.
Figure 13D:
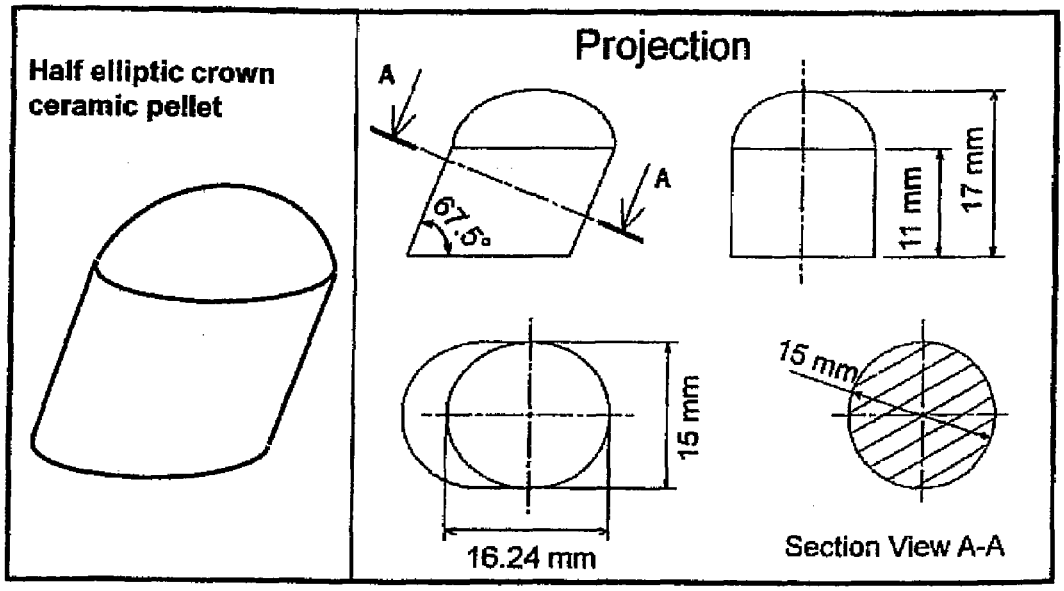
FIG. 13D shows a pellet according to the invention cut at an angle of 67.5 degrees and having a half elliptical crown.

To further deflect an incoming projectile and defeat penetration, pellets with convex crowns may be used, as shown in FIGS. 13B-D. While angled pellets have the ability to turn the projectile, domed pellets have the ability to deflect and turn projectiles, thereby enhancing effectiveness.

FIG. 13B illustrates the use of a round crown having a radius of 10 mm. If the center of the hemisphere lies on a line 902 perpendicular to the back surface 904 of the pellet, the cross section (A-A) taken perpendicular to the longitudinal centerline 906 of the pellet may be oval shaped. In the embodiment shown, with an angle of 67.5 degrees, "a" measures 15.6 mm and "b" measures 14.4 mm. The invention is not limited in the regard, however, as angles other than 67.5 degrees may be used, which would alter the dimensions of "a" and "b." In the case where the angle of the pellet is 90 degrees, "a" and "b" would be equal.

Figure 14A:
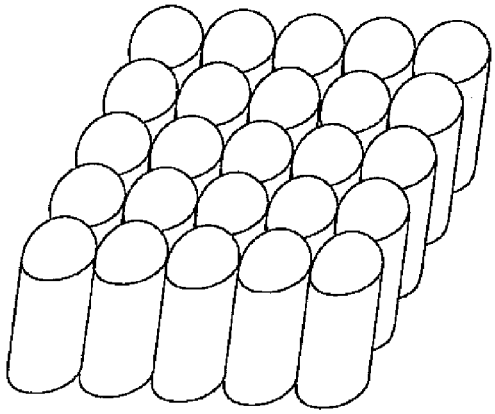
FIG. 14A depicts a square-packed array of dome-crowned pellets.
Figure 14B:
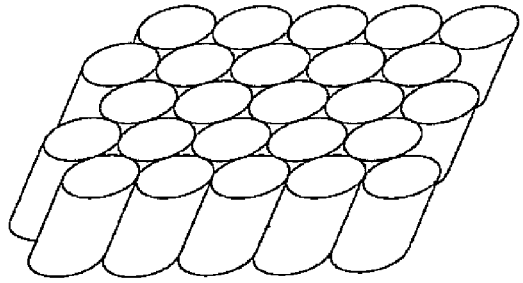
FIG. 14B depicts a hexagonal close-packed array of dome-crowned pellets.

In the dome-crowned embodiments of the invention, the convexity need not be hemispherical or symmetrical about an axis. FIG. 13C depicts a crown that is partially elliptical, whereas FIG. 13D shows a crown that is half-elliptic, both allowing for a circular cross section (A-A). As with the other embodiments of this invention, the dome-crowned pellets may be square-packed, as shown in FIG. 14A, or hexagonally close-packed as shown in FIG. 14B.

Once packed, the pellets are embedded in epoxy or other matrix material, with or without netting. The packed pellets may be made into tiles, with or without back plates through a flexible support structure. The multi-layer structure of FIG. 12 may also be used with the dome-crowned pellets, in which case the outer-facing array of pellets would include the domed surfaces, whereas the inner array would have pellets with flat, parallel surface. The angle of the inner array and that of the outer array need not be the same.

I claim:

1. Lightweight, composite ballistic armor, comprising:

an array of ceramic pellets, each pellet having a front surface, a back surface and a longitudinal centerline; and wherein:

the front surface of each pellet is intentionally convex, the front and back surfaces of the pellets define parallel, spaced-apart front and back planes, and the longitudinal centerlines of the pellets are parallel to one another and angled relative to the front and back planes at an angle other 90 degrees.

2. The lightweight, composite ballistic armor of claim 1, wherein the front surface of each pellet is hemispherical.

3. The lightweight, composite ballistic armor of claim 1, wherein:

the front surface of each pellet is hemispherical; and the cross-section of the pellet taken perpendicular to the centerline is oval-shaped.

4. The lightweight, composite ballistic armor of claim 1, wherein the front surface of each pellet is elliptical.

5. The lightweight, composite ballistic armor of claim 1, wherein:

the front surface of each pellet is elliptical; and the cross-section of the pellet taken perpendicular to the centerline is circular.

6. The lightweight, composite ballistic armor of claim 1, wherein:

the back surface of each pellet is substantially flat; and the pellets are arranged with the flat surfaces in a flat back plane.

7. The lightweight, composite ballistic armor of claim 1, wherein the pellets are arranged in a square matrix.

8. The lightweight, composite ballistic armor of claim 1, wherein the pellets are arranged in a hexagonally close-packed matrix.

9. The lightweight, composite ballistic armor of claim 1, wherein the array of pellets are embedded in a hardened thermoset or thermoplastic polymer matrix material.

10. The lightweight, composite ballistic armor of claim 1, wherein:

the array of pellets are tied together with fibrous netting material; and the tied pellets are embedded in a hardened matrix.

11. The lightweight, composite ballistic armor of claim 1, wherein:

the array of pellets are tied together with fibrous netting material; and the tied pellets are embedded in a hardened matrix; and the matrix is strengthened with a nano-clay component.

12. The lightweight, composite ballistic armor of claim 1, wherein the array of pellets are embedded in a hardened matrix material forming a plurality of front plates, and further including:

a flexible, web-based support structure; and a plurality of tiles attached to the support structure, each tile including a front plate disposed on one side of the support structure, a back plate disposed on the other side of the support structure, and one or more fasteners for joining each front plate to a corresponding back plate through the support structure.

13. The lightweight, composite ballistic armor of claim 12, wherein each back plate is a composite structure including opposing panels filled with a resin impregnated matrix.

14. The lightweight, composite ballistic armor of claim 12, wherein the back and front plates are co-extensive.

15. The lightweight, composite ballistic armor of claim 12, wherein the web-based support structure can bend along lines between the tiles, resulting in a hinged sheet that can be draped over a vehicle or other thing to be protected.

16. The lightweight, composite ballistic armor of claim 12, wherein the ceramic pellets are bound together with a network of cables embedded in the hardened matrix material.

* * * * *